United States Patent [19]

Blanquet et al.

[11] 4,361,023

[45] Nov. 30, 1982

[54] MANDREL-RESTRAINING ASSEMBLY FOR A TUBE-ROLLING MILL

[76] Inventors: Claude Blanquet, 3, rue de la Tête Noire, Berlaimont, France, 59145; André Fichel, 45 avenue des Lilas Les Floralies, Marly, France, 59770

[21] Appl. No.: 269,451

[22] Filed: Jun. 2, 1981

[30] Foreign Application Priority Data

Jun. 6, 1980 [FR] France ..... 80 12609

[51] Int. Cl.[3] ..... B21B 47/10; B21C 45/00

[52] U.S. Cl. ..... 72/209; 72/208

[58] Field of Search ..... 72/208, 209, 290, 291, 72/422, 97

[56] References Cited

U.S. PATENT DOCUMENTS 3,857,267 12/1974 LeMaire et al. ..... 72/209

4,311,032 1/1982 Nessi ..... 72/208

*Primary Examiner*—Carl E. Hall

*Assistant Examiner*—Jonathan L. Scherer

*Attorney, Agent, or Firm*—Pollock, Vande Sande & Priddy

[57] ABSTRACT

A restraining assembly for holding back and then releasing a mandrel which supports a tube being rolled in a rolling mill has a fork supported by a carriage which is driven by two endless chains. The carriage is articulated to two opposite links of the chains and the separation of the fork from the mandrel takes place as the chains run around end wheels and the carriage is tilted. To control this movement of the carriage the fork is at the forward or downstream end of the carriage and an additional connection is provided between the carriage and another link of at least one chain, preferably with play in the direction of movement of the chain.

8 Claims, 4 Drawing Figures

MANDREL-RESTRAINING ASSEMBLY FOR A TUBE-ROLLING MILL

Figure 1:
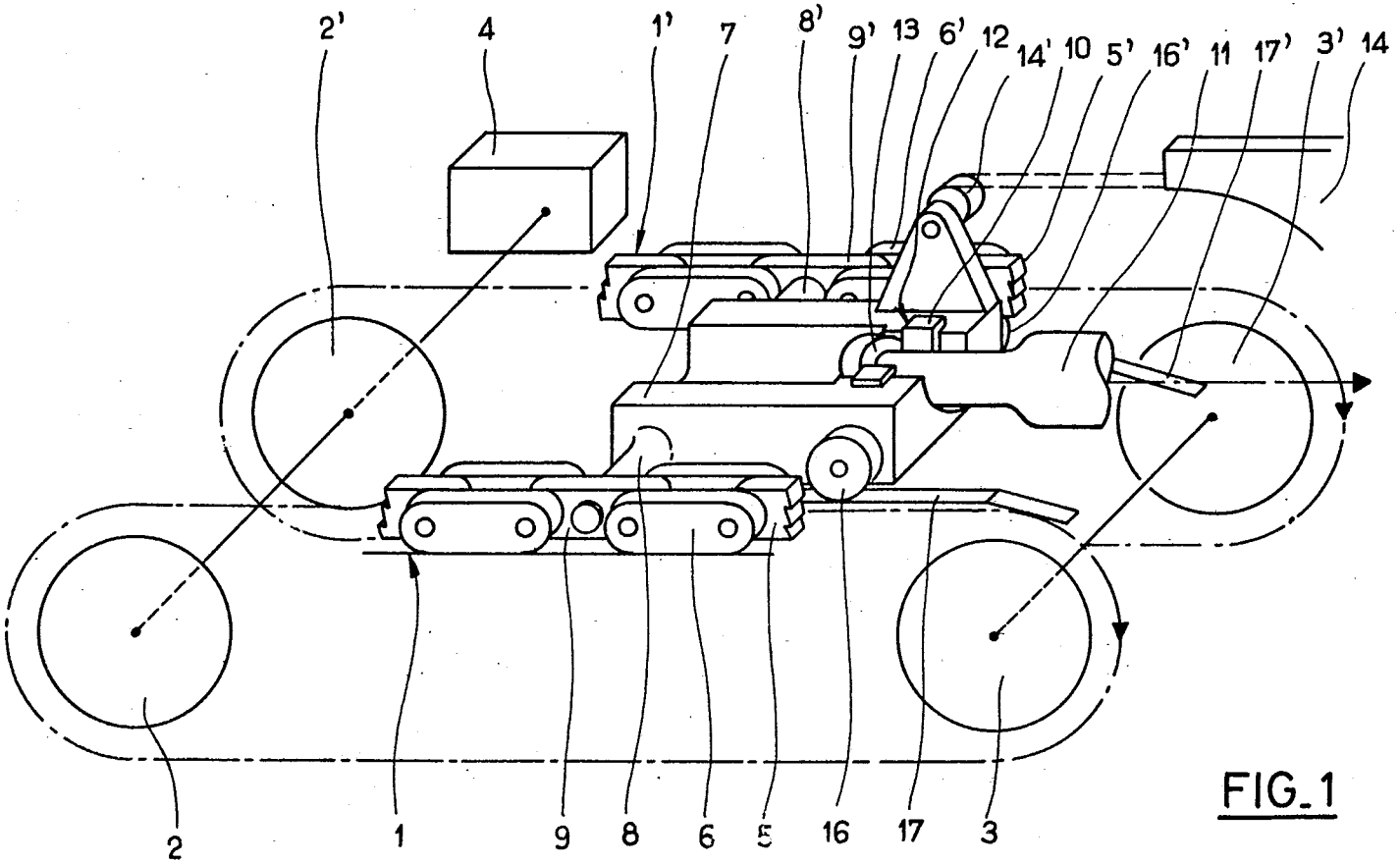

The invention relates to a restraining bench for holding back and then releasing a mandrel driven in a rolling mill by a tube to which the mandrel is assigned.

This rolling mill is, for example, a continuous rolling mill, and the technique for manufacturing the tube involves for example, the mandrel which carries the tube at its end being first restrained at a controlled speed during the rolling of the tube and then being released, so as to pass through the rolling mill, following the tube.

A technique of this type is described in French Pat. No. 2,198,797.

It is known to retain the mandrel by means of a fork which is first displaced over a rectilinear path parallel to the axis of the rolling mill and which is then retracted to release the mandrel. This displacement and this retraction are effected by fixing the fork transversely to two links, located opposite one another, of two endless chains arranged in paralled along a rectilinear path between a drive wheel and a tensioning wheel, the position of which is adjustable.

The winding of the chains round the tensioning wheels causes the progressive disengagement of the fork by varying the angle which the fork forms with the contact surface of the mandrel.

It is found, in practice, that this variation, which is imposed by the chains, does not always take place at the speed or at the angle which is appropriate. The problem to be solved is to prevent the untimely disengagement of the mandrel from the fork, this disengagement taking place upwards prematurely and abruptly, while the fork tilts, at the same time as it withdraws from the rolling-line, with an inclination equal to that of the link to which it is connected.

This problem is solved by fixing the fork not directly to the chain, but to a carriage articulated to two links, facing one another, of the chains, and by arranging cams in the region of the tensioning wheels so as to control the change of direction of the carriage in the critical zone of retraction.

This solution has the disadvantage of mechanical complexity and makes it necessary to displace the cams and to make the adjustments again when the return wheels of the chains have to be displaced, for example, to modify the tension of the chains.

The present invention aims to preserve the advantages of the carriage with respect to the prior solution, whilst avoiding the need to resort to cams.

This object is achieved, according to the invention, by providing, as well as the articulation of the carriage to the chains, an additional connection between the chains and the carriage and by positioning the fork in the downstream part of the carriage. The two articulated connections to the chain are made on different links. The two articulated connections of the carriage are arranged so as to permit a clearance at the level of one of the two carriage/chain articulated joints. Without a clearance, it would no longer be possible to wind the chains onto the drive and tensioning wheels. It must be understood that the additional connection can be made on one side only, on only one of the chains and not necessarily on both.

Only the main connection without an axial clearance relative to the link supporting it must be duplicated so as to distribute the retaining strain over the two chains.

A preferred solution for putting the invention into effect involves providing the clearance at the level of the downstream articulated connection. The pulling force exerted by the mandrel on the carriage, which force is transmitted to the chain by way of the connection without clearance, occurs in this way, for as long as possible, over the rectilinear portion of the travel of the chain, whereas, if the opposite arrangement were adopted, a part of the pulling force would occur over a larger non-rectilinear portion.

For reasons of construction, the links of the chain to which the articulated connections are made are blocks. These blocks are, in general, connected to one another by means of intermediate or flat segments. This is the normal composition of a chain.

A simple embodiment of this additional connection consists, for one chain or for both chains, of an auxiliary axle integral with the carriage and engaging, with the possibility of sliding, in a preferably longitudinal slot in one link of at least one of the two chains. This additional connection can also be made by means of an auxiliary axle integral with a link of one of the chains and engaging, with the possibility of sliding, in a preferably longitudinal slot in the carriage.

The fork is preferably located in the vicinity of the downstream articulated connection.

Figure 2:
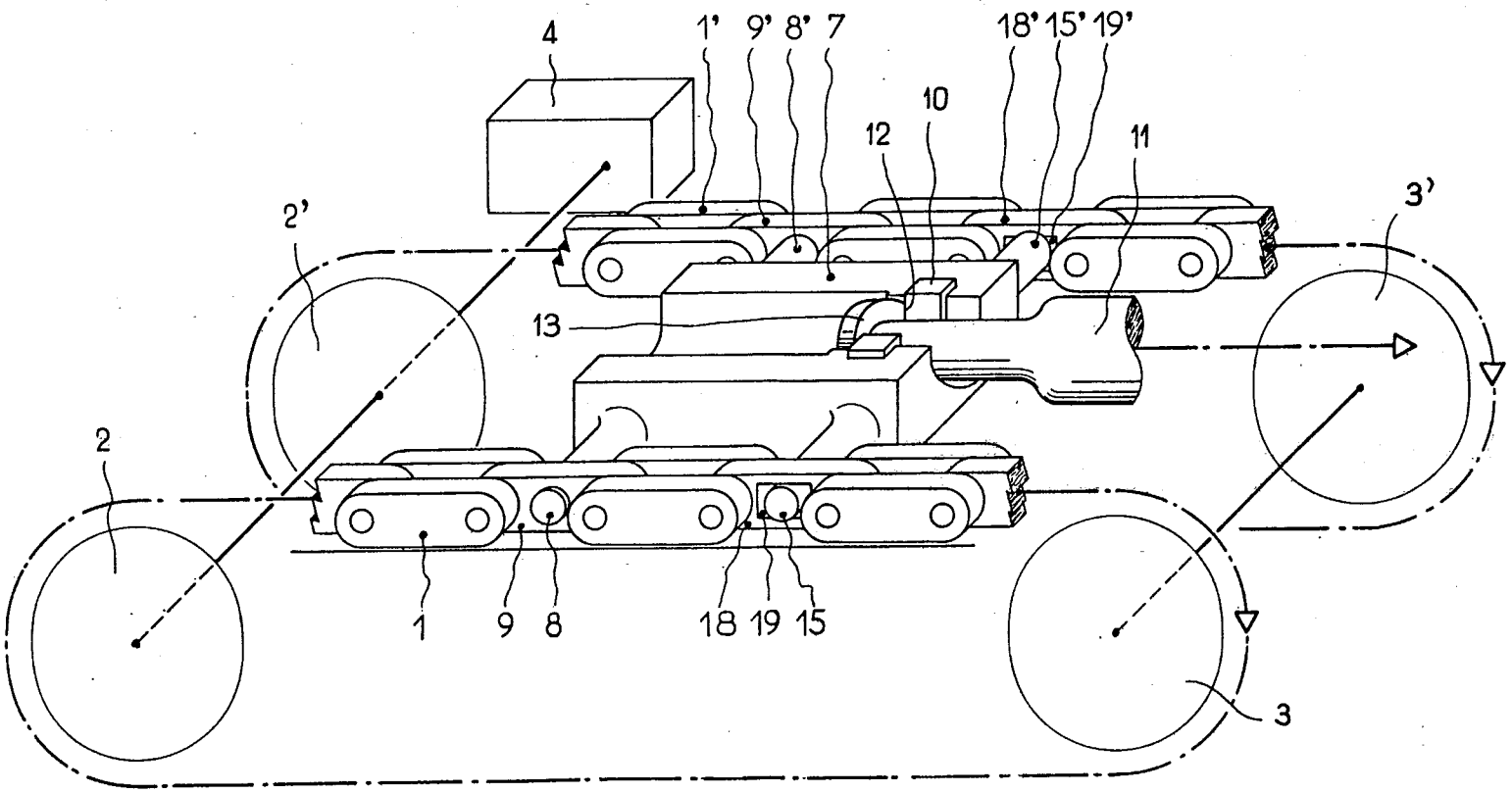
Figure 3:
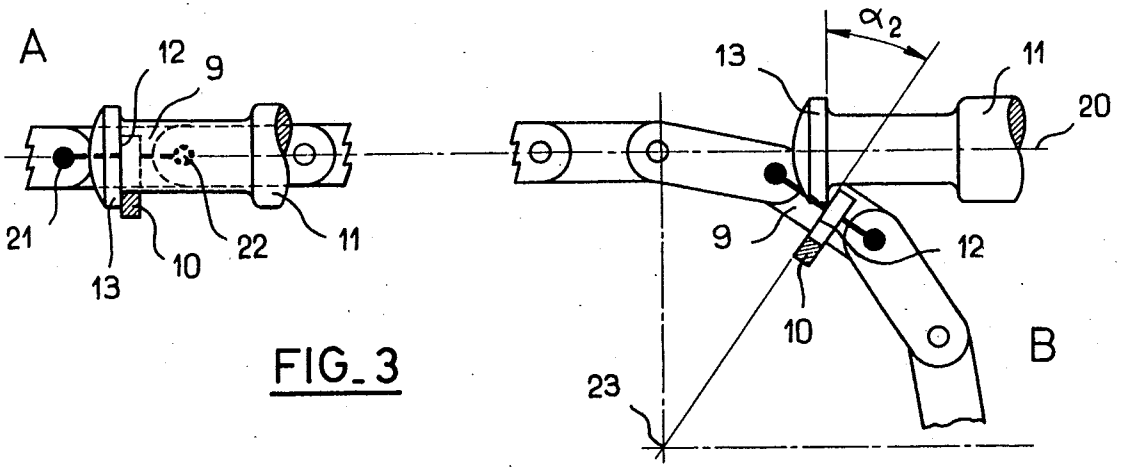
Figure 4:
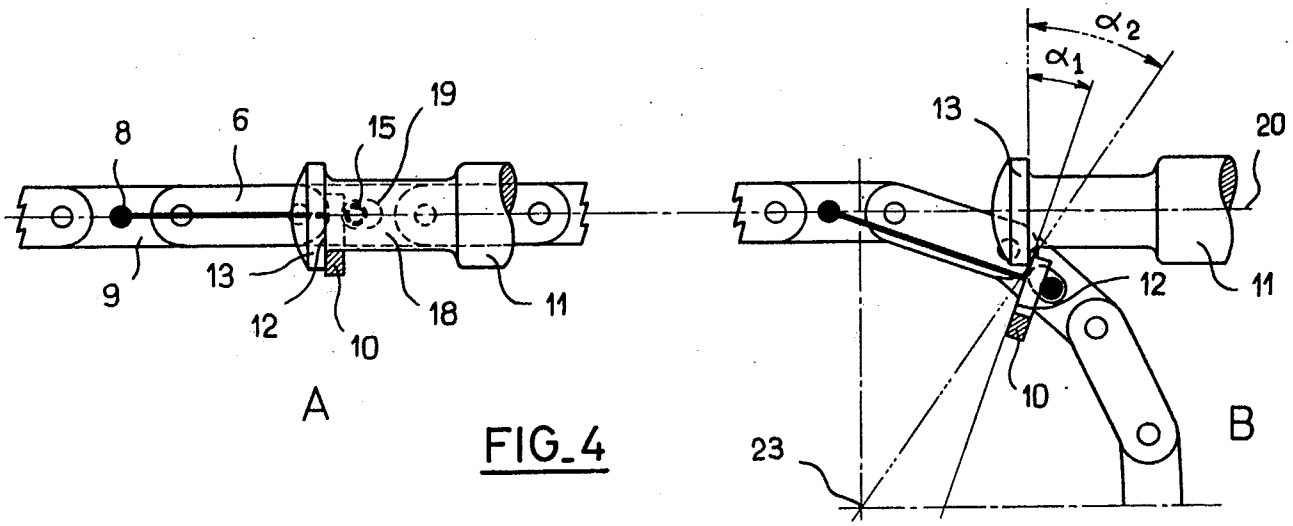

A preferred embodiment of a restraining assembly according to the invention will be described below with reference to the Figures of the attached drawings in which:

FIG. 1 is a basic diagram of a known restraining assembly,

FIG. 2 is a basic diagram of a restraining assembly according to the present invention, FIG. 3 is a diagram illustrating the position of the fork with its mandrel in the pulling axis and at the moment of release of the mandrel, in the case of a fork connected to two links opposite one another, FIG. 4 is a diagram illustrating the position of the fork with its mandrel in the pulling axis and at the moment of release of the mandrel, according to the device of the invention.

FIG. 1 is a highly diagrammatic general view of a known restraining assembly. The assembly comprises two parallel chains (1-1'), each forming a closed circuit between a drive wheel (2-2') and an idle return and tensioning wheel (3-3'). The drive wheels (2-2') are driven by means of a motor (4). Each chain consists of a succession of links or blocks (5-5'), each connected, to the next by intermediate or flat segments (6-6'). The assembly also comprises a carriage (7) fixed to the chains by means of lateral axles (8-8') which are articlated pivotably on two links opposite one another (9-9'). This carriage supports a fork (10) which is intended to retain the mandrel (11) as a result of contact of the retaining surface (12) of the fork with a shoulder (13) of the mandrel; rollers (16-16') integral with the carriage maintain the latter in the axis of passage during the working stroke by means of rolling tracks (17-17') themselves parallel to the axis of passage. Located in the vicinity of the tensioning wheels (3-3') is a cam (14) to which a cam roller (14') mounted on an arm integral with the carriage corresponds, so that, at the end of the stroke, the roller (14') causes, under the action of the cam (14), a rapid disengagement of the fork, the profile of the tracks (17-17') being designed, in this zone, to permit this movement.

There is no need to describe in detail this known embodiment, the illustration of which is a simple basic diagram.

As will be seen from FIG. 2, the restraining assembly of the invention comprises a carriage (7) which is connected to the chains (1-1') not only by the lateral axles (8-8'), but also by auxiliary lateral axles (15-15'). The axles (8-8') are articulated pivotably on two links (9-9'), opposite one another, of the chains (1-1'), whilst the auxiliary axles (15-15') correspond to the links (18-18') which immediately precede the links (9-9') and which are separated from these only by an intermediate segment. These axles can move in longitudinal slots (19-19') of the links (18-18'), where they are retained firmly. The slots (19-19') are preferably rectilinear according to the longitudinal axis of the chain.

Similar arrangements are adopted for the other chain and are indicated by the same reference numerals marked with prime.

The fork (10) consists, for example, of an appropriate piece cut out from the carriage itself or of an attached piece. The invention is not limited to a particular fork.

Because of the possibility of directing the carriage by its two upstream and downstream axles of articulation, with a clearance, during the passage of the chain over the return and tensioning wheel (3-3'), the angle which the fork forms with the axis of the mandrel during the tilting of the carriage varies less rapidly than in the case of a fork connected rigidly to the chain, to such an extent that the angle formed by the plane of the retaining surface of the fork and the plane of the bearing surface of the shoulder of the mandrel remains always such that $tg\alpha$ is less than f, f being the coefficient of relative friction of these two surfaces; the result of this is that the strain of retaining the mandrel has no component directed upwards, as would be the case if $tg\alpha$ became greater than f, and that the mandrel has no tendency to slip out upwards during the releasing phase, this always being accompanied by bending forces in the mandrel shoulder and by metal-tearing forces in its bearing face.

FIGS. 3 and 4 illustrate what has just been said these Figures show diagrammatically the fork (10), the mandrel (11) with its shoulder (13) bearing on the retaining surface (12) of the fork, and the connections of the fork to the chains.

For a good distribution of the pulling forces of the chains, the axis of the mandrel is parallel to the axis of the chains and in the plane of the horizontal axis of the chains, shown at (20).

In the prior art without a carriage (FIG. 3), the fork is connected rigidly to two links or blocks opposite one another (9), and its retaining plane (12) remains, during the displacement of the chain, perpendicular to the link, that is to say, to the line joining the axles (21-22) of the chain.

The prior art shown in FIG. 1 is very inconvenient in practice because of the disadvantages already mentioned: it is necessary to resort to a cam which is separate from the driving device and the adjustment of which presents problems.

According to the invention (FIG. 4), the carriage (not shown) supporting the fork is connected to the chains by the articulated axles (8) and (15) on the links or blocks (9) and (18) separated by a flat segment (6), the slot for clearance being shown at (19).

In the displacement of the chain the retaining plane (12) of the fork remains perpendicular to the line joining the axles (8-15) and is taken to the vicinity of the downstream part of the carriage.

The position shown in A corresponds to any position of the rectilinear part of the chain, the position shown in B corresponding to the position of the mandrel and fork at the moment of release of the mandrel by the fork.

The angle $\alpha$ formed by the retaining plane of the fork and the plane of the bearing surface of the shoulder of the mandrel varies from 0 to a maximum value $\alpha 1$ (FIG. 4) at the moment of release. In the prior art, the same angle varies from 0 to $\alpha 2$, with $\alpha 2$ being greater than $\alpha 1$, because of the construction.

The relation $tg\alpha 1$ less than f, which was explained above, is then much easier to maintain, and the mandrel has no tendency to slip out upwards during the releasing phase.

The value of the angle $\alpha 1$, which is a limiting value at the moment of release, can be reduced by increasing the distance between, the two articulated axles (8) and (15), mounting the articulated axles (8) and (15) on links or blocks separated by more than one intermediate or flat segment.

In an alternative embodiment, the chain can consist of a cable provided with elements similar to links.

In an alternative embodiment, the axle constituting the additional connection is fixed relative to the link which drives it, and has a clearance, in a slot of the carriage.

We claim:

1. In a mandrel - restraining assembly for holding back and releasing a mandrel carrying a tube in a rolling mill, the assembly comprising two endless chains arranged in parallel, a carriage articulated to two opposed links of the said chains and driven by the chains, and a mandrel-retaining fork on the carriage, the improvement which comprises an additional connection between the carriage and another link of at least one of the chains, said connection providing play in the lengthwise direction of the chains, and the fork being located in the downstream part of the carriage.

2. An assembly according to claim 1, characterised in that the additional connection involves two respective links opposite one another, of the two chains.

3. An assembly accordingly to claim 1 characterised in that the additional connection is located downstream of the articulated connection.

4. An assembly according to claim 3, characterised in that the additional connection consists of an axle which is fixed to the carriage and which is retained firmly, with the possibility of sliding, in the length of a slot in a link of the chain, or vice versa.

5. An assembly according to claim 4, characterised in that the slot extends longitudinally.

6. An assembly according to claim 5, characterised in that the slot is rectilinear.

7. An assembly according to claim 1 characterised in that the additional connection involves the link immediately adjacent to the link to which the carriage is articulated.

8. An assembly according to claim 1 characterised in that the fork is located in the vicinity of the additional connection.

* * * * *